US007249868B2

(12) United States Patent
Chinniah et al.

(10) Patent No.: US 7,249,868 B2
(45) Date of Patent: Jul. 31, 2007

(54) LAMP HOUSING WITH INTERIOR COOLING BY A THERMOELECTRIC DEVICE

(75) Inventors: Jeyachandrabose Chinniah, Canton, MI (US); Mitchell E. Sayers, Saline, MI (US); Harvinder Singh, Shelby Township, MI (US); James D. Tarne, West Bloomfield, MI (US); John A. Duszkiewicz, Livonia, MI (US); Paul A. Lyon, Ann Arbor, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 20 days.

(21) Appl. No.: 11/176,636

(22) Filed: Jul. 7, 2005

(65) Prior Publication Data

US 2007/0008727 A1 Jan. 11, 2007

(51) Int. Cl.
*F21V 29/00* (2006.01)

(52) U.S. Cl. ..... 362/294; 362/345; 362/373; 362/547

(58) Field of Classification Search ..... 362/294, 362/373, 547, 345, 264
See application file for complete search history.

(56) References Cited

U.S. PATENT DOCUMENTS 6,517,218 B2 2/2003 Hochstein
6,682,211 B2 1/2004 English et al.
6,805,474 B2 10/2004 Walser et al.
6,827,470 B2 12/2004 McCullough et al.
6,964,501 B2 * 11/2005 Ryan ..... 362/294
2002/0070360 A1 6/2002 Machi
2003/0031028 A1 2/2003 Murray et al.
2004/0114355 A1 6/2004 Rizkin et al.
2004/0120156 A1 6/2004 Ryan
2004/0202007 A1 10/2004 Yagi et al.
2004/0213016 A1 * 10/2004 Rice ..... 362/547
2004/0252520 A1 12/2004 Martineau et al.
2004/0256630 A1 12/2004 Cao
2005/0018446 A1 1/2005 Ishida
2005/0029535 A1 2/2005 Mazzochette et al.
2005/0047170 A1 3/2005 Hilburger et al.
2005/0052878 A1 3/2005 Yamada et al.
2006/0181894 A1 * 8/2006 Chinniah et al. ..... 362/547

* cited by examiner

*Primary Examiner*—Stephen F. Husar
(74) *Attorney, Agent, or Firm*—Brinks Hofer Gilson & Lione

(57) ABSTRACT

A lamp system having a housing, wall portions defining a cavity and an opening. A light source, generally an LED, is located within the cavity and at least one thermoelectric device is disposed in one of the wall portions. The thermoelectric device has a first side oriented towards the cavity and the second side oriented away from the cavity. When in operation, the thermoelectric device will transfer heat from inside the cavity, via the first side of the thermoelectric device, to the second side of the thermoelectric device.

7 Claims, 1 Drawing Sheet

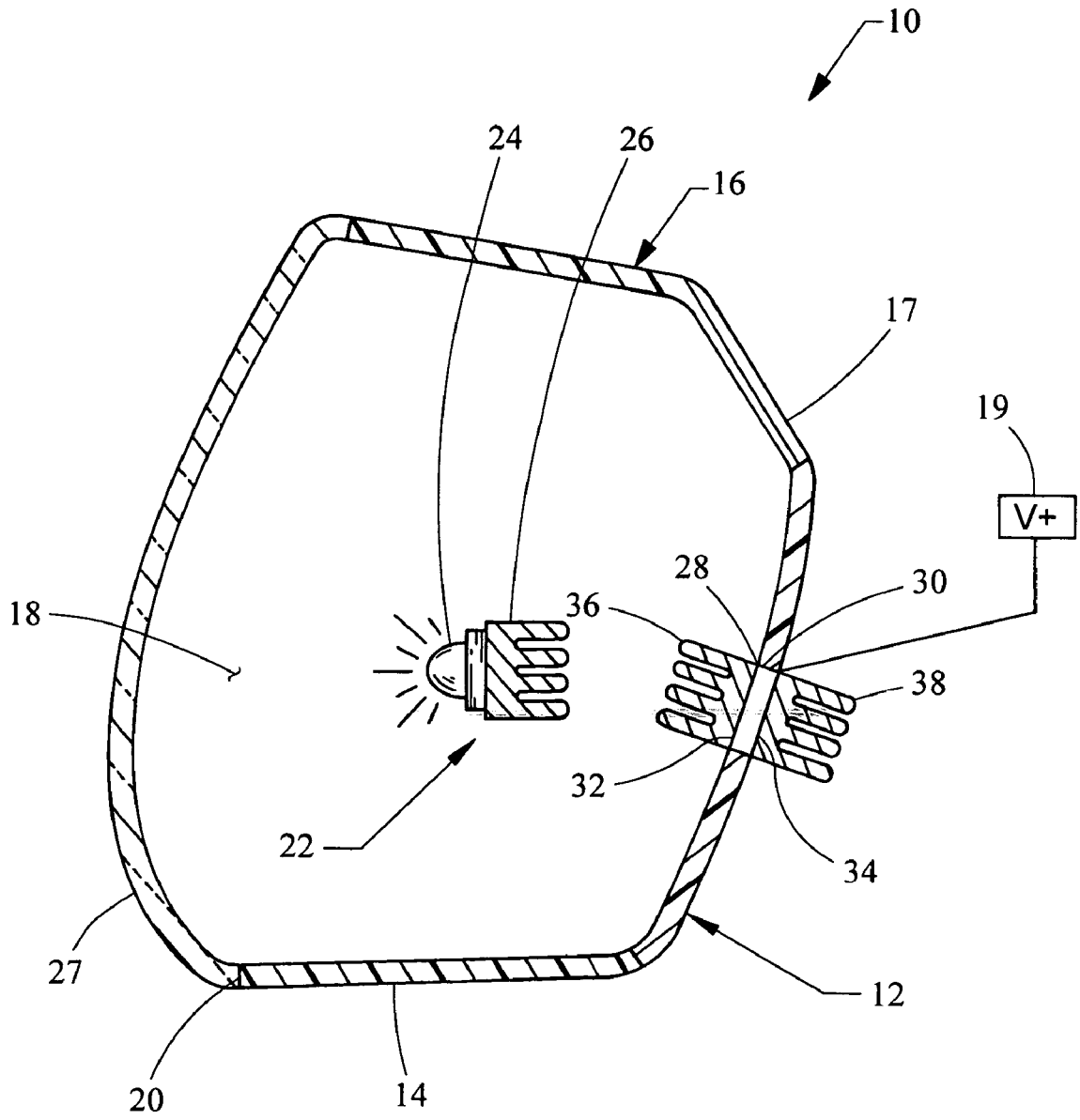
10
24
26
16
17
19
V+
28
30
36
18
38
32
22
34
27
12
20
14

LAMP HOUSING WITH INTERIOR COOLING BY A THERMOELECTRIC DEVICE

BACKGROUND

1. Field of the Invention

The present invention generally relates to automobile lighting systems and more particularly to automobile lighting systems utilizing light emitting diodes ("LEDs").

2. Description of the Known Technology

Currently, LEDs are typically used in automobiles to provide lighting for the interior cluster and the brake lights of an automobile. Used in such applications, LEDs have several advantages over traditional incandescent light bulbs. For example, LEDs have increased brightness, faster response times, low electrical current requirements, longer operating life and can be surface mounted, unlike traditional incandescent bulbs which typically require through-hole mounts.

Even with the above advantages, LEDs have rarely been utilized to provide forward lighting for an automobile. This is because LEDs have the drawback of losing light output at higher diode junction temperatures compared to a more commonly utilized incandescent bulb. If the LED generates too much heat and the heat is not efficiently dissipated, the LED will fail.

The smaller LEDs used for brake lights effectively dissipate heat with the aid of a heat exchanging substrate. Through convection, heat is dissipated from the heat exchanger to the surrounding environment.

Since, the lighting requirements for effective forward lighting are greater than that for automobile brake lighting, more powerful (higher light output) and/or greater numbers of LEDs must be utilized, such powerful and/or greater numbers of LEDs will generate more heat than the smaller LEDs used to provide automobile brake lighting. Unfortunately, the before-mentioned solution is unable to provide effective heat dissipation because the amount of heat generated by the more powerful and/or greater number of LEDs.

Therefore, there exists a need for a solution that provides LEDs with superior heat dissipation.

BRIEF SUMMARY

In overcoming the drawbacks and the limitations of the known technologies, a lamp system with enhanced heat dissipation capabilities is disclosed. The system includes a housing, wall portions defining a cavity, at least one thermoelectric device disposed in the wall portions, an opening and a transparent lens cover coupled to the wall portions to cover the opening of the housing. Located within the cavity is a light source.

The thermoelectric device is disposed such that one side faces towards the cavity and the second opposing side faces away from the cavity. Generally, heat exchangers, in the form of heat sinks, are coupled to the opposing sides of the thermoelectric device. In operation, the thermoelectric device will extract heat from the side of the thermoelectric device located toward the cavity and transfer it to the opposite side where it is dissipated.

The light source further includes a lamp coupled to a heat exchanger. The lamp generally being an LED and the heat exchanger is a heat sink.

These and other advantages, features and embodiments of the invention will become apparent from the drawings, detailed description and claims which follow.

BRIEF DESCRIPTION OF THE DRAWINGS

The FIGURE is a plan view of a lamp system embodying the principles of the present invention.

DETAILED DESCRIPTION

Referring now to the FIGURE, a lamp system 10 is shown. Preferably, the lamp system 10 is used to provide for forward lighting of an automobile. However, the lamp system 10 may be used to provide lighting for fog lamps, brake lamps or any other lamps that are part of, but not limited to, an automobile.

The lamp system 10 includes a housing 12 having first and second side wall portions 14, 16 and a back wall portion 17 defining a cavity 18 and an opening 20. Generally, the wall portions 16, 14, are constructed of a rigid and/or insulating material, such as plastic. However, the wall portions 14, 16 of the housing 12 may be made of any material suitable for this purpose.

A transparent lens cover 27 is coupled to the housing 12 such that the opening 20 of the cavity 18 is closed. The transparent lens cover 27 is preferably made of a transparent plastic but may be made of any transparent material, such as glass.

Rigidly mounted within the cavity 18 by a bracket or other means (not shown) is a light source 22. The light source includes lamp 24 and a lamp heat exchanger 26, which is coupled to the lamp to provide cooling thereto. Preferably, the lamp 24 is a light emitting diode ("LED") or an LED array, but may be any light source suitable for the intended purpose. Preferably, the lamp heat exchanger 26 is a vertical finned heat sink, but may be a liquid cooled heat exchanger, a forced air convection heat exchanger or any heat exchanging device that is now known or later developed. In order to provide electrical power to the lamp 24, a wire harness (not shown) is connected to the lamp 24. When in operation, the lamp 24 will generate heat, which will be dissipated, by convection, through the lamp heat exchanger 26. Unfortunately, the heat lamp exchanger 26 may be unable to provide adequate heat dissipation for the lamp 24. Therefore, as described below, supplemental cooling for the lamp 24 will be provided by a thermoelectric device.

Defined within the back wall portion 17 is an aperture 28. Placed within the aperture 28 is a thermoelectric device 30. Alternatively, the aperture 28 and the thermoelectric device 30 may be located with the first or second side wall portions 14, 16. The thermoelectric device 30 may be mounted to the wall portions 14, 16 by suitable means including, but not limited to, adhesives, screws, clips, or frictional engagement. An electrical power source 19 is connected to the thermoelectric device 30. The electrical power source 19 provides to appropriate current to the thermoelectric device 30 for operation.

In the context of this description, the term "thermoelectric device" is used in a broad sense of its ordinary and customary meeting, which is (1) conventional thermoelectric modules, (2) quantum tunneling converters, (3) thermionic modules, (4) magneto caloric modules, (5) elements utilizing one, or any bi-combination of, thermoelectric, magneto caloric, quantum tunneling and thermionic effects, (6) acoustic heating mechanisms, (7) any other sold state heat pumping device (8) any combination, array, assembly and other structure of (1) through (7) above.

The thermoelectric device 30 has a cold side 32, oriented towards the light source 22, and a hot side 34 oriented away from the light source 22. Connected to and in thermal communication with the cold side 32 and the hot side 34 are a cold side heat exchange 36 and a hot side heat exchanger 38, respectively. Generally, the cold side heat exchanger 32 and the hot side heat exchanger 34 are vertical finned heat sinks but may be liquid cooled heat exchangers, forced air convection heat exchangers or any heat exchanging devices suitable for this purpose. Preferably, the cold side heat exchanger 32 and the lamp heat exchanger 26 are oriented such that heat will be transferred from the lamp exchanger 26 to the cold side heat exchanger 32 as is possible. In order to achieve efficient heat transfer, the lamp heat exchanger 26 and the cold side heat exchanger 32 are substantially opposed to one another with both heat exchangers 26, 32 being vertical finned heat sinks.

During operation, the direction of the current flowing through the thermoelectric device 30 is provided such that the cold side 32 cools and the hot side 34 warms. The current flowing through the thermoelectric device 30 removes heat from the cold side 32 and deposits it on the hot side 34, where the heat is dissipated by the hot side heat exchanger 38. As heat generated by the lamp 24 is dissipated by the lamp heat exchanger 26, some of this heat will be taken up by the cold side heat exchanger 36. By warming the cold side heat exchanger 36 with heat received from the lamp heat exchanger 26, the temperature differential between the cold side 32 and the hot side 34 is reduced, allowing the thermoelectric device 30 to operate more efficiently.

As heat is removed from the cold side 32 to the hot side 34, a greater amount of heat is extracted from the cavity 18. This greater heat dissipation allows for superior cooling of the light source 22 allowing for the implementation of more powerful and/or more numerous LEDs within the cavity 18.

As a person skilled in the art will readily appreciate, the above description is meant as an illustration of implementation of the principles of this invention. This description is not intended to limit the scope or application of this invention in that the invention is susceptible to modification, variation and change, without departing from spirit of this invention, as defined in the following claims.

The invention claimed is:

1. A lamp comprising:

a housing having wall portions defining a cavity and an opening;

a transparent lens cover coupled to the wall portions and covering the opening;

a light source located within the cavity;

at least one thermoelectric device located within one of the wall portions, the thermoelectric device having a first side oriented substantially towards the cavity and a second side oriented substantially away from the cavity, whereby the first side will transfer heat generated by the light source to the second side;

whereby the light source further comprises a lamp and a first heat exchanger, the lamp coupled to the first heat exchanger; and a second heat exchanger coupled to the first side of the thermoelectric device, the second heat exchanger oriented substantially towards the first heat exchanger, thereby providing greater heat transfer between the first and second heat exchangers.

2. The system of claim 1, wherein the wall portions further comprise a back wall, a first side wall and a second side wall.

3. The system of claim 1, wherein the first heat exchanger is a heat sink.

4. The system of claim 1, wherein the lamp is a light emitting diode.

5. The system of claim 1, wherein the first and second heat exchangers are vertical finned heat sinks.

6. The system of claim 1, further comprising a third heat exchanger coupled to the second side of the thermoelectric module.

7. The system of claim 6, wherein the heat exchanger is a heat sink.

* * * * *

UNITED STATES PATENT AND TRADEMARK OFFICE

CERTIFICATE OF CORRECTION

PATENT NO. : 7,249,868 B2
APPLICATION NO. : 11/176636
DATED : July 31, 2007
INVENTOR(S) : Jeyachandrabose Chinniah et al.

It is certified that error appears in the above-identified patent and that said Letters Patent is hereby corrected as shown below:

On the Title Page

Item (75), delete "John A. Duszkiewicz" and substitute --Alan J. Duszkiewicz-- in its place.

Signed and Sealed this

Thirtieth Day of October, 2007

JON W. DUDAS
*Director of the United States Patent and Trademark Office*